United States Patent [19]

Hamai et al.

[11] 4,327,698

[45] May 4, 1982

[54] EXHAUST GAS RECIRCULATING DEVICE

[75] Inventors: Kyugo Hamai; Tsuyoshi Nakano; Yoshimi Uchida, all of Yokosuka, Japan

[73] Assignee: Nissan Motor Co., Ltd., Yokohama, Japan

[21] Appl. No.: 110,305

[22] Filed: Jan. 8, 1980

[30] Foreign Application Priority Data

Jan. 10, 1979 [JP] Japan ..... 54-585

[51] Int. Cl.[3] ..... F02M 25/06

[52] U.S. Cl. ..... 123/568

[58] Field of Search ..... 123/568, 569, 570, 571

[56] References Cited

U.S. PATENT DOCUMENTS 1,877,937 9/1932 Moore ..... 123/568 X 2,722,927 11/1955 Cornelius ..... 123/568

*Primary Examiner*—Wendell E. Burns

*Attorney, Agent, or Firm*—James C. Wray

[57] ABSTRACT

An exhaust gas recirculating device in which the intake mixed fuel gas passageway is surrounded by a double wall tube which defines a ring shaped space therebetween. Recirculating exhaust gas is introduced into the ring shaped space to heat the inner tube of the double wall to ease vaporization of the wall stream of fuel and the exhaust gas is blown out from a narrowed outlet of the space so as to well mix the fuel gas mixture and the recirculating exhaust gas.

11 Claims, 7 Drawing Figures

EXHAUST GAS RECIRCULATING DEVICE

BACKGROUND OF THE INVENTION

The present invention relates to an exhaust gas recirculating device used in an internal combustion engine with carburetor of the type for suppressing amount of NOx in the exhaust gas by applying an exhaust gas recirculation. The device is to mix the three items, i.e. fuel, intake air and recirculating exhaust gas to unify the feature of the mixed gas to be supplied to each of the cylinders and thus to improve the distribution characteristics of the mixed gas.

In the conventional system of the exhaust gas recirculation of an internal combustion engine with carburetor, a pipe shaped recirculating exhaust gas passageway is connected to one portion of the intake manifold to recirculate a part of the exhaust gas and said exhaust gas is concentratedly blown out into the mixed gas. In such a system, the recirculating exhaust gas is introduced into the mixed gas with partial concentration so that the mixing of the gases may not become uniform and hence the mixture gas distribution characteristics among each of the cylinders may variate.

The mixed gas has both a gas phase in which the fuel is well vaporized and a liquid phase in which the fuel is not well vaporized and attached on the inner wall of the intake gas passageway and flow down along the wall surface to form a so-called wall stream. This liquid phase portion is difficult to let uniformly distribute among each one of the cylinders mainly owing to the shape of the intake manifold. Accordingly, the air fuel ratio of the mixed gas for each cylinder may fluctuate. This results variation of the combustion and increase of quantity of unburned components in the exhaust gas, such as HC, CO, etc. so that the fuel cost increases by the non-effective utilization of the fuel.

There was a proposal to accelerate the vaporization of the liquid phase fuel by heating the riser portion of the intake manifold. However, the conventional system is not sufficient for realizing good vaporization. Especially the conventional construction of the exhaust gas recirculation system is not suited to use the heat of recirculating exhaust gas for the acceleration of the vaporization of the wall stream of the fuel.

SUMMARY OF THE INVENTION

In view of the foregoing situation, the present invention is particularly aimed at the vaporization of the mixed gas which has not been considered in the previous proposals. The present invention is to realize an exhaust gas recirculating device in which the intake gas passageway leading the mixed gas stream is heated outwardly at downstream of the carburetor to accelerate vaporization of the fuel wall stream flowing down along the wall of the intake gas passageway, and the wall of the intake gas passageway causing the wall stream is cut out and the recirculating exhaust gas stream is blown from the terminating end of the wall so that the liquid phase fuel is taken along and mixed with the recirculating exhaust gas and vaporized by the heat of the exhaust gas. As a result the device may contribute to acceleration of vaporization of the liquid phase fuel by the recirculating exhaust gas, for acceleration of mixture of fuel, intake air, and recirculating exhaust gas thereby improving the distribution characteristics of the mixed gas between the respective cylinders.

DESCRIPTION OF THE PREFERRED EMBODIMENT

Embodiment of the present invention will be explained hereinafter by referring to the accompanied drawings.

Figure 1:
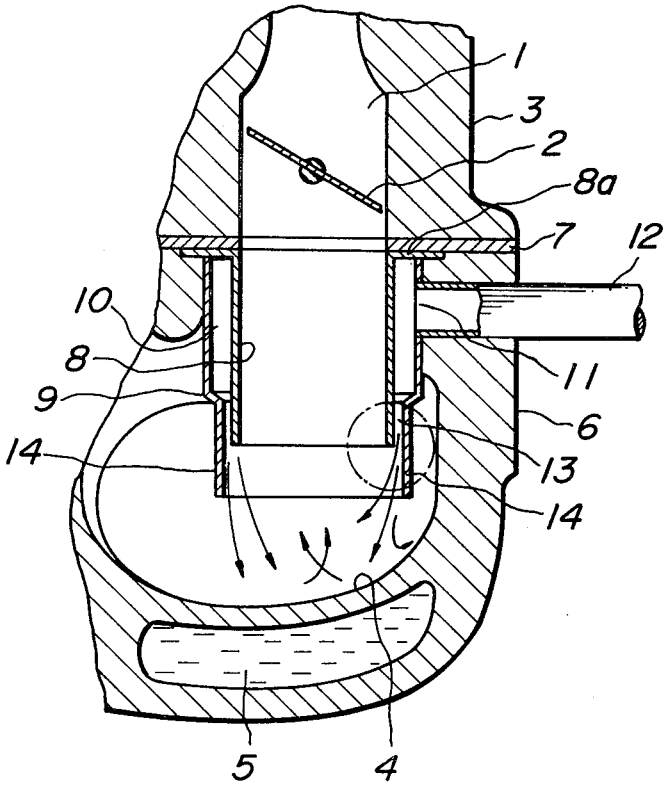
FIG. 1 is a vertical cross-sectional view of one embodiment of the present invention.
Figure 2:
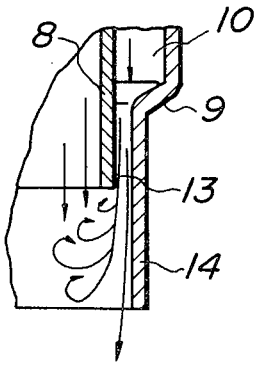
FIG. 2 is a partial enlarged view of FIG. 1.

In FIGS. 1 and 2, a carburetor 3 provided with a throttle valve 2 in the intake gas passageway 1 is connected in a conventional manner with an intake manifold 6 with an intervention of a gasket 7. Riser portion 4 of the intake manifold 6 is heated by the engine cooling water in the water jacket 5.

An inner cylindrical tube 8 having the same inner diameter with that of the intake gas passageway 1 at downstream of the carburetor 3 is provided at a position above the riser portion 4 of the intake manifold 6. Surrounding the inner cylindrical tube 8, an outer cylindrical tube 9 is arranged concentrically therewith to form a ring shaped space 10 between the two tubes 8 and 9. An inlet 11 for the recirculating exhaust gas is formed on the outer cylindrical tube 9. A part of the exhaust gas derived from the exhaust gas passageway 12 of the engine not shown in the drawing is introduced in the inlet 11.

The upper end of the ring shaped space 10, namely the upstream end of the mixed gas stream passing through the inner tube 8 is closed by a flange 8*a* which is formed by bending the upper end of the inner tube 8 outwardly. Lower end of the ring shaped space 10, namely the outlet portion of the recirculating exhaust gas is narrowed by decreasing the diameter of the outer tube 9 to form a narrow restricted ring shaped nozzle 13 as shown in the drawing. The decreased diameter portion of the outer tube 9 is extended downwardly beyond the lower end of the inner tube 8 to form an exhaust portion 14.

In the above construction of the device of the present invention, the intake air and the fuel are mixed in the carburetor 3 and the mixed fuel gas flows down through the inner tube 8 is guided towards the intake manifold 6. In this case, droplets of fuel not well vaporized flows down along the inner wall of the intake gas passageway 1 and that of the inner tube 8. A part of the exhaust gas of the engine introduced in the ring shaped space 10 through the exhaust gas recirculating passageway 12 heats up the inner tube 8 since it is at high temperature. By this the above droplets in the wall stream of the fuel flowing down the wall are vaporized. Since the recirculating exhaust gas is blown out at increased flow rate towards the riser portion 4 of the intake manifold 6 by passing through the narrowed nozzle 13 at the outlet of the ring shaped space 10, unvaporized wall stream fuel droplet flowing down the wall of the inner tube 8 may be carried along by the comparatively high speed recirculating exhaust gas stream when dropping off the end of the inner tube 8 to form mist. The fuel mist may be vaporized easily by the heat of the exhaust gas and is mixed with the main stream of fuel gas mixture flowing through the inner tube 8 from its outer periphery. Accordingly, the three elements, i.e. the fuel, the intake air and the recirculating exhaust gas are well mixed to form a uniformly mixed gas. This means the nature of the mixed gas is uniform and substantially improved. Since the extended portion 14 of the lower end of the outer tube 9 is longer than the lower end of the inner tube 8, the stream of the recirculating exhaust gas form a turbulent flow to form inward vortex as shown in the enlarged view of FIG. 2. Therefore, the mixing of the recirculating exhaust gas and the central flow of the mixed gas stream is accelerated more effectively.

Figure 3:
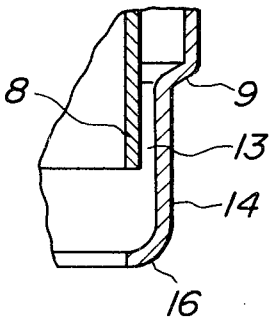
FIG. 3 is a modified embodiment of FIG. 2.

In order to form the vortex or swirl flow of the recirculating exhaust gas more positively or to direct it towards the center of the main mixed gas stream, it is possible to bend the extending portion of the outer tube 9 inwardly to form a bent portion 16 as shown in FIG. 3. In this case, it is preferred to arrange the top of the bent portion 16 clear off the inner surface of the inner tube 8. This is to avoid any disturbance for the mixed gas stream passing through the inner tube 8 by said bent portion 16.

In general, outlet openings of the inner tube 8 and the outer tube 9 are directed to blow the mixed gas stream and the recirculating exhaust gas stream towards the riser portion 4 of the intake manifold 6. This means that relatively large size droplets of the fuel carried by the mixed stream of the mixed gas and the recirculating exhaust gas may be directed to the riser portion 4 when the mixed stream changes its direction at the riser portion 4. These droplets of the fuel if not vaporized in the mixture are heated at the surface of the riser portion 4, which is in turn heated by the engine cooling water in the water jacket 5 and thus vaporization is completed.

Figure 4:
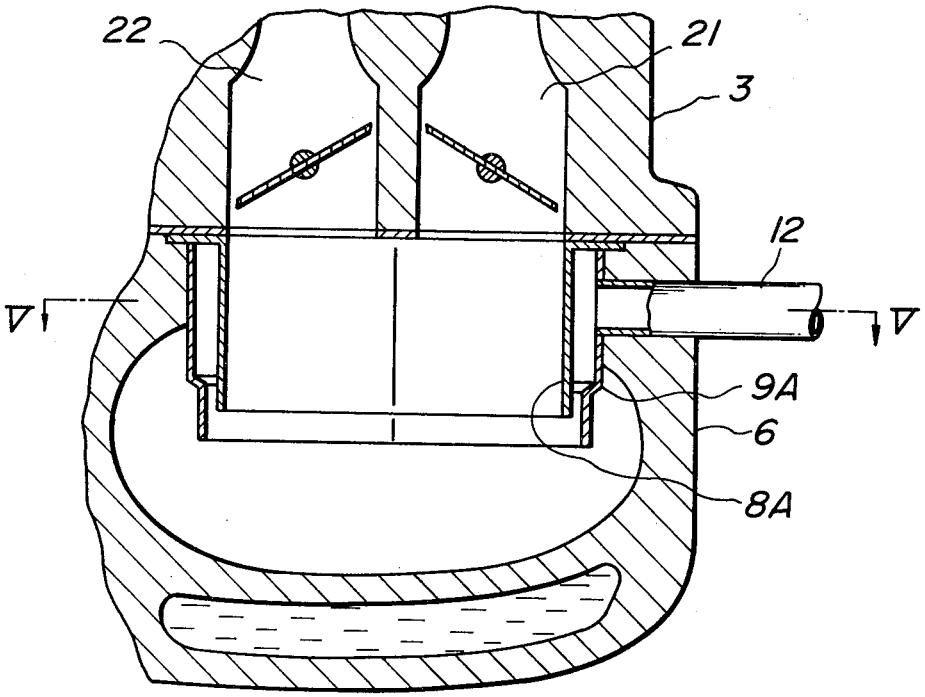
FIG. 4 is a vertical cross-sectional view of another embodiment of the present invention.
Figure 5:
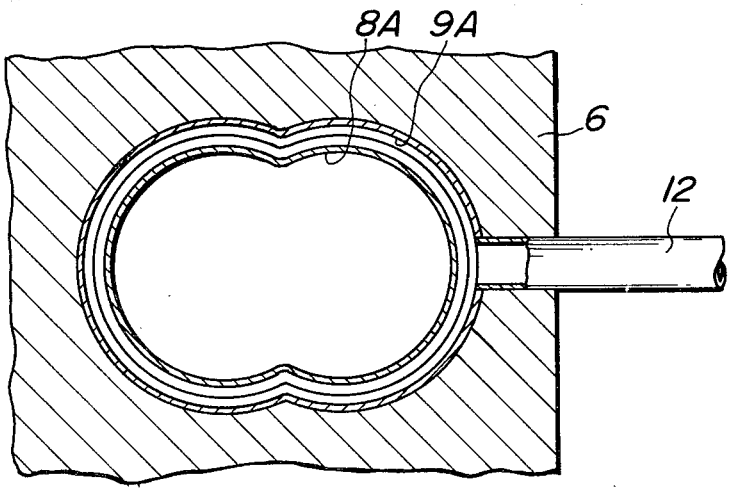
FIG. 5 is a cross-sectional view taken along the line V—V of FIG. 4.

It is very easy to apply the present invention as of its one embodiment to an intake manifold of a two-barrel type carburetor having primary barrel 21 and secondary barrel 22 as shown in FIGS. 4 and 5. As shown in these drawings a double tube having an inner tube 8A and an outer tube 9A and being made as a tumbler shaped is arranged below the primary barrel 21 and the secondary barrel 22. It is also possible to arrange two double tubes below the primary barrel 21 and the secondary barrel 22, respectively. But the illustrated construction is more simplified and better suited for the manufacture and assembly.

Figure 6:
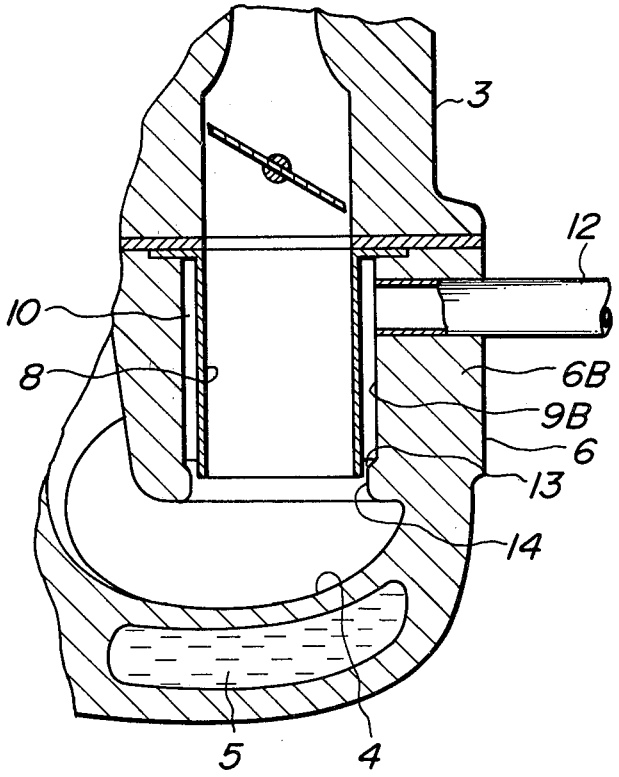
FIG. 6 and FIG. 7 are vertical cross-sectional views for showing further modified embodiments of the present invention, respectively.

The outer tube 9B may be formed by using an inner wall 6B of the intake manifold 6 as shown in FIG. 6.

Figure 7:
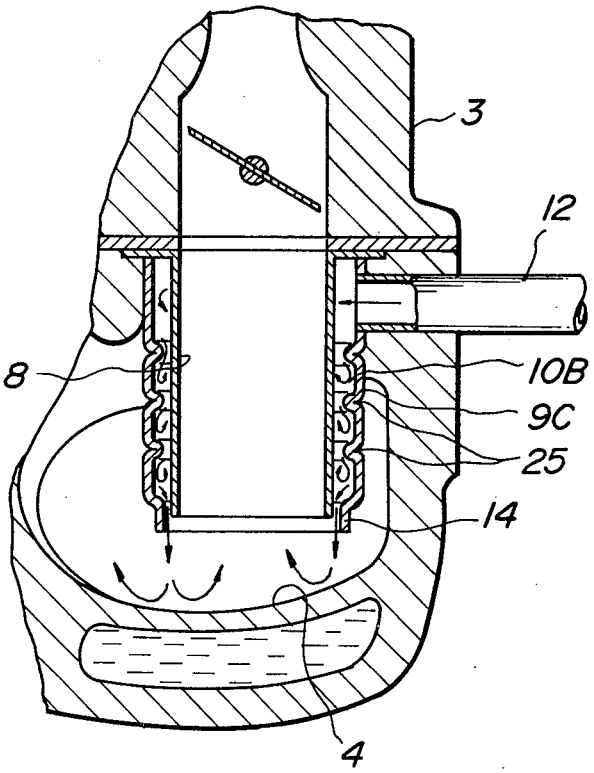

FIG. 7 shows still further embodiment of the present invention. In this embodiment, the outer tube 9C is pressed to form a plurality of ring shaped inner rims 25 in the inside so as to retard the flowing speed of the recirculating exhaust gas in the ring shaped space 10B to elongate the dwelling time of the flow. By this the heat exchange between the exhaust gas flow and the inner tube is improved and the fuel droplets of the wall stream flowing down on the inner surface of the inner tube 8 is further accelerated for its vaporization. This modified embodiment has an object to prolong the dwelling time of the recirculating exhaust gas passing through the ring shaped space 10B. Accordingly, the ring shaped inner rims 25 may be formed on the inner tube 8 alternatively. In this case, the heat exchanging efficiency can be improved better than the case when the rims are provided on the outer tube 9C. The ring shaped space itself may be provided with restrictions to increase the flow resistance or it may have suitable buffle plates on the wall to alter the flowing path.

In the foregoing embodiments, it is possible to arrange a guide vane at the outlet portion of the ring shaped space in order better to direct the recirculating exhaust gas and to accelerate the mixing with the mixed fuel gas. Such a guide vane may be provided either on the inner tube or on the outer tube just as same as the aforementioned rims 25.

As has been explained in the foregoing, according to the present invention, the wall of the intake gas passageway having possible wall stream of the fuel is heated at the downstream of the carburetor by using recirculating exhaust gas stream, the wall of the intake gas passageway causing the wall stream is interrupted above the riser portion and a high speed recirculating exhaust gas stream is injected into the intake gas stream from nozzle shaped outlet so that vaporization efficiency with the mixed gas is improved and also the mixing of three elements, i.e. fuel, intake air and the recirculating exhaust gas can be made more quickly and evenly. As the effects of the present invention, the utilizing efficiency of the fuel is improved, the feature of distribution of the fuel and the recirculating exhaust gas for each cylinder is improved and the variation of combustion in the exhaust gas recirculation is suppressed and hence the allowable limit of the amount of supply of the recirculating exhaust gas and also the limit of lean mixed gas can both be increased. As the result the amount of unburned gas component of HC, CO and etc. in the exhaust gas can be decreased. This means that capacity of the exhaust gas treatment such as the catalyst device can be miniaturized and the fuel cost can greatly be saved. By the increase of the limit of the exhaust gas recirculation, NOx can be reduced greatly and the control of the exhaust gas recirculation can be effected very easily.

What is claimed is:

1. An exhaust gas recirculating device provided in an intake manifold at downstream of a carburetor of an internal combustion engine comprising a double tube positioned in the intake manifold adjacent a riser portion of the manifold, said double tube having an inner tube and an outer tube defining a ring shaped space therebetween, wherein mixed gas is arranged to flow inside said inner tube toward said riser portion, a recirculating exhaust gas passageway introducing a part of exhaust gas of the engine is connected to said ring shaped space, an outlet end of said ring shaped space for expelling said recirculating exhaust gas toward said riser portion is narrowed from periphery to increase flowing speed of said recirculating exhaust gas, and an end of said outer tube at the outlet of the ring shaped space is made longer than that of the inner tube to project beyond the inner tube and terminate within said riser portion.

2. An exhaust gas recirculating device as claimed in claim 1, wherein the end of the outer tube at the outlet end of the recirculating exhaust gas of the ring shaped space is formed to bend inwardly.

3. An exhaust gas recirculating device as claimed in claim 1, wherein the outer tube is formed by an inner wall of the intake manifold.

4. An exhaust gas recirculating device as claimed in claim 1, wherein buffle members such as rims, restrictions for elongating dwelling time of the recirculating exhaust gas flowing through the ring shaped space is formed on at least one of the inner tube and the outer tube.

5. An exhaust gas recirculating device as claimed in claim 1, wherein guide vane means for forming vortex streams of injected recirculating exhaust gas is provided on at least one of the said tubes at the outlet end of the ring shaped space.

6. An exhaust gas recirculating device as claimed in claim 1, wherein a jacket is provided on the riser portion for directing engine coolant against said riser portion to heat said riser portion.

7. An exhaust gas recirculating device as claimed in claim 1, wherein heating means are provided for supplying heat to the riser portion which is independent of the mixed gas and recirculating exhaust gas.

8. An exhaust gas recirculating device provided in an intake manifold at downstream of a carburetor of an internal combustion engine comprising a double tube having an inner tube and an outer tube defining a ring-shaped space therebetween, wherein mixed gas is arranged to flow inside said inner tube, a recirculating exhaust gas passageway introducing a part of exhaust gas of the engine is connected to said ring shaped space, outlet end of said ring-shaped space for deriving out said recirculating exhaust gas is narrowed from periphery to increase flowing speed of said recirculating exhaust gas, and an end of said outer tube at the outlet of the recirculating exhaust gas of the ring-shaped space is made longer than that of the inner tube to project beyond it, wherein the inner tube is made of high heat conductive material and the outer tube is made of a material having less heat conductivity than that of the inner tube.

9. An exhaust gas recirculating device provided in a vertically extending intake manifold at below and downstream of a carburetor of an internal combustion engine comprising a double wall construction having an inner tube and an outer body surface defining a ring shaped space therebetween, wherein mixed gas of the engine is arranged to flow inside said inner tube downwardly, a recirculating exhaust gas passageway introducing a part of exhaust gas of the engine being connected to said ring shaped space at upper portion thereof, outlet end of said ring shaped space for deriving out said recirculating exhaust gas is narrowed from outer periphery by the outer body surface to increase flowing speed of said recirculating exhaust gas, and an end of said outer body surface at the outlet of the recirculating exhaust gas of the ring shaped space is made longer than that of the inner tube to project beyond it.

10. An exhaust gas recirculating device as claimed in claim 9, wherein the outlet of the recirculating exhaust gas formed by the end of said ring shaped space is so arranged as to direct the recirculating exhaust gas injected from the ring shaped space toward a riser portion of the intake manifold.

11. An exhaust gas recirculating device as claimed in claim 9, wherein the outer body surface is formed by an inner wall of the intake manifold.

* * * * *